US008662643B2

(12) United States Patent
Sakata et al.

(10) Patent No.: US 8,662,643 B2
(45) Date of Patent: Mar. 4, 2014

(54) LIQUID JET HEAD AND LIQUID JET APPARATUS

(71) Applicants: Akifumi Sakata, Chiba (JP); Yoshinori Domae, Chiba (JP)

(72) Inventors: Akifumi Sakata, Chiba (JP); Yoshinori Domae, Chiba (JP)

(73) Assignee: SII Printek Inc. (JP)

( * ) Notice: Subject to any disclaimer, the term of this patent is extended or adjusted under 35 U.S.C. 154(b) by 0 days.

(21) Appl. No.: 13/625,927

(22) Filed: Sep. 25, 2012

(65) Prior Publication Data

US 2013/0083143 A1 Apr. 4, 2013

(30) Foreign Application Priority Data

Sep. 27, 2011 (JP) ..... 2011-211218

(51) Int. Cl.
*B41J 2/05* (2006.01)
*B41J 2/18* (2006.01)

(52) U.S. Cl.
USPC ..... 347/65; 347/89

(58) Field of Classification Search
USPC ..... 347/54, 56, 65–68, 85, 89
See application file for complete search history.

(56) References Cited

U.S. PATENT DOCUMENTS

| | | | | | |
|---|---|---|---|---|---|
| 4,883,219 | A * | 11/1989 | Anderson et al. | ..... | 228/190 |
| 5,231,424 | A * | 7/1993 | Kaneko et al. | ..... | 347/29 |
| 5,625,393 | A * | 4/1997 | Asai | ..... | 347/69 |
| 6,715,863 | B2 * | 4/2004 | Shimizu | ..... | 347/85 |
| 7,537,318 | B2 * | 5/2009 | Fujii et al. | ..... | 347/66 |
| 7,661,798 | B2 * | 2/2010 | Mukai et al. | ..... | 347/56 |
| 7,850,290 | B2 * | 12/2010 | Nitta et al. | ..... | 347/85 |
| 2011/0193920 | A1 | 8/2011 | Aruga et al. | ..... | 347/93 |

FOREIGN PATENT DOCUMENTS

JP 2004351641 12/2004

* cited by examiner

*Primary Examiner* — Anh T. N. Vo
(74) *Attorney, Agent, or Firm* — Adams & Wilks

(57) ABSTRACT

A head chip includes an actuator substrate having channels for liquid ejection formed therein, and a cover plate having a liquid supply chamber for supplying liquid to the channels, the cover plate being stacked on the actuator substrate. A flow path member mounted to the cover plate supplies the liquid to the liquid supply chamber. The flow path member includes an inflow port through which the liquid flows in, an outflow port through which the liquid flows out, and a circulation path along which the liquid is circulated from the inflow port to the outflow port. No filter is interposed in either the flow path between the inflow port and the channels or the flow path between the outflow port and the channels. The sectional area of the circulation path in a direction orthogonal to the circulating direction of liquid flow is larger than that of the liquid supply chamber.

11 Claims, 5 Drawing Sheets

LIQUID JET HEAD AND LIQUID JET APPARATUS

BACKGROUND OF THE INVENTION

1. Field of the Invention

The present invention relates to a liquid jet head which ejects liquid from nozzles to form images and letters on a recording medium or to form a thin film material, and a liquid jet apparatus using the same.

2. Description of the Related Art

In recent years, there has been used an ink jet type liquid jet head which ejects ink droplets onto recording paper and the like to draw letters and diagrams, or ejects a liquid material onto a surface of an element substrate to form a functional thin film. The liquid jet head of this type is supplied with ink or a liquid material from a liquid tank via a supply tube, and is caused to eject the ink or the liquid material filled in channels thereof from nozzles communicated to the channels. At the time of ink ejection, the liquid jet head and a recording medium for recording the jetted liquid are moved, to thereby record the letters and diagrams or form the functional thin film in a predetermined shape.

For example, Japanese Patent Application Laid-open No. 2004-351641 describes the liquid jet head of this type. FIG. 9 is a schematic view illustrating an ink flow path of a printing head 101 described in Japanese Patent Application Laid-open No. 2004-351641 (FIG. 2 of Japanese Patent Application Laid-open No. 2004-351641). At a lower portion of the printing head 101, there are provided an ink ejection nozzle 201 for ejecting ink downwardly and a nozzle liquid chamber 202 for supplying ink to the ink ejection nozzle 201. On a right side of an upper portion of the printing head 101, there are provided an OUT liquid chamber 301 for supplying ink to the nozzle liquid chamber 202 and an IN liquid chamber 204 for supplying ink to the OUT liquid chamber 301 via a head filter 203. The head filter 203 is arranged vertically or at an inclination. Ink sent in a tube 114 under pressure flows into a lower portion of the IN liquid chamber 204, and flows out from an upper portion of the IN liquid chamber 204 to enter a tube 115.

The head filter 203 is provided between the OUT liquid chamber 301 and the IN liquid chamber 204, and the ink circulates via the tube 114, the IN liquid chamber 204, and the tube 115. Further, the OUT liquid chamber 301 is arranged above the nozzle liquid chamber 202. With this structure, air bubbles do not pass through the head filter 203 at the time of cleaning, and are discharged outside together with the ink circulation due to the buoyancy of the air bubbles. Therefore, the flow rate of ink to be used in circulation cleaning can be remarkably reduced as compared to a conventional liquid jet head.

In the above-mentioned conventional example, the head filter 203 provided between the IN liquid chamber 204 and the OUT liquid chamber 301 is provided for removing dust mixed into the ink. However, when the head filter 203 is inserted between an ink inflow portion and the ink ejection nozzle 201, the pressure loss of the ink flowing in the printing head 101 increases, and thus a printing stable zone, which represents a condition range for stable ejection of ink, becomes narrower. For example, a voltage range which enables stable printing becomes narrower. Further, along with the use of the printing head 101, air bubbles adhere to the head filter 203 on the IN liquid chamber 204 side and accumulate in the IN liquid chamber 204. As a result, the effective area of the head filter 203 reduces to cause shortage of ink supply to the nozzle liquid chamber 202 side. Further, the air bubbles accumulated in the IN liquid chamber 204 may pass through the head filter 203 to flow into the nozzle liquid chamber 202, which may cause deterioration of printing quality such as dot missing.

SUMMARY OF THE INVENTION

The present invention has been made in view of the above-mentioned problem, and has an object to provide a liquid jet head which is capable of preventing a printing stable zone from being narrowed, and preventing ejection characteristics from being deteriorated due to air bubble accumulation and the like.

According to an exemplary embodiment of the present invention, there is provided a liquid jet head, including: a head chip including: an actuator substrate having a channel for liquid ejection formed therein; and a cover plate having a liquid supply chamber for supplying liquid to the channel formed therein, the cover plate being stacked on the actuator substrate; and a flow path member, which is provided to the cover plate, for supplying the liquid to the liquid supply chamber. The flow path member includes: an inflow port through which the liquid flows in; an outflow port through which the liquid flows out; and a circulation path along which the liquid is circulated from the inflow port to the outflow port, and no filter is interposed in any of a flow path between the inflow port and the channel and a flow path between the outflow port and the channel.

Further, the channel includes a plurality of channels arrayed on a surface of the actuator substrate on the cover plate side, the liquid supply chamber is communicated to the plurality of channels, and is formed into an elongated shape long in an arraying direction of the plurality of channels, and the circulation path has a sectional area in a direction orthogonal to a direction of liquid flow, which is larger than a sectional area of the liquid supply chamber in a direction orthogonal to an elongated direction thereof.

Further, the liquid supply chamber is opened on a surface of the cover plate on the flow path member side, the circulation path is opened on a surface of the flow path member on the cover plate side, and the circulation path and the liquid supply chamber are arranged so that an opening of the circulation path and an opening of the liquid supply chamber are overlapped with each other.

Further, the sectional area of the circulation path in the direction orthogonal to the direction of the liquid flow gradually reduces from an upstream side to a downstream side.

Further, the head chip comprises a first head chip and a second head chip which are stacked.

Further, the first head chip and the second head chip have a symmetric structure in which an actuator substrate of the first head chip and an actuator substrate of the second head chip are opposed and bonded to each other, the flow path member includes: a first flow path member provided to the first head chip; and a second flow path member provided to the second head chip, the head chip includes an inflow through hole and an outflow through hole which pass through the head chip from the first flow path member side to the second flow path member side, and the liquid flows into the second flow path member from the first flow path member via the inflow through hole, and flows into the first flow path member from the second flow path member via the outflow through hole.

Further, the first head chip and the second head chip have a symmetric structure in which an actuator substrate of the first head chip and an actuator substrate of the second head chip are opposed and bonded to each other, the flow path member includes: a first flow path member provided to the first head chip; and a second flow path member provided to the second head chip, and the first flow path member and the second flow path member have a symmetric structure across the first head chip and the second head chip.

Further, the circulation path is arranged above the liquid supply chamber in a gravity direction.

According to an exemplary embodiment of the present invention, there is provided a liquid jet apparatus, including: the liquid jet head having any one of the above-mentioned configurations; a moving mechanism for reciprocating the liquid jet head; a liquid supply tube for supplying liquid to the liquid jet head; and a liquid tank for supplying the liquid to the liquid supply tube.

The liquid jet head according to the exemplary embodiment of the present invention includes the head chip and the flow path member. The head chip includes the actuator substrate having the channel for liquid ejection formed therein, and the cover plate having the liquid supply chamber for supplying liquid to the channel formed therein, the cover plate being stacked on the actuator substrate. The flow path member is provided to the cover plate and supplies the liquid to the liquid supply chamber. The flow path member includes the inflow port through which the liquid flows in, the outflow port through which the liquid flows out, and the circulation path along which the liquid is circulated from the inflow port to the outflow port. No filter is interposed in any of flow paths between the inflow port or the outflow port and the channel.

With this structure, air bubbles and dust mixed into the liquid that has flowed into the flow path member flow via the circulation path to flow out from the outflow port. Further, no filter is interposed between the inflow port or the outflow port and the channel. Therefore, it is possible to provide a liquid jet head which is capable of preventing the air bubbles from accumulating to the filter to gradually reduce a flow path sectional area, and preventing an ejection stable zone from being reduced due to the pressure loss by the filter.

DETAILED DESCRIPTION OF THE PREFERRED EMBODIMENTS

Figure 1:
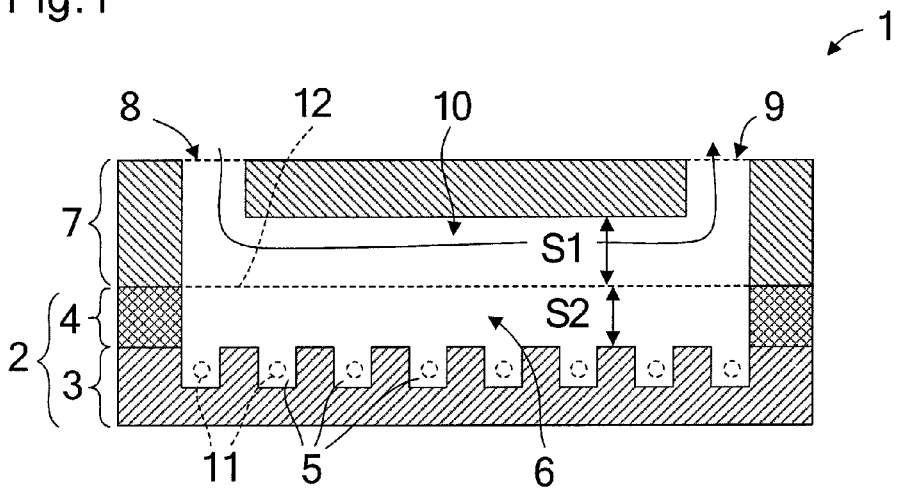
FIG. 1 is a conceptual view illustrating a basic structure of a liquid jet head according to the present invention.

FIG. 1 is a conceptual view illustrating a basic structure of a liquid jet head 1 according to the present invention. The liquid jet head 1 includes a head chip 2 and a flow path member 7. The head chip 2 includes an actuator substrate 3 having a plurality of channels 5 for liquid ejection formed therein, and a cover plate 4 having a liquid supply chamber 6 for supplying liquid to the channels 5 formed therein. The flow path member 7 is provided to the cover plate 4 and supplies liquid to the liquid supply chamber 6.

The flow path member 7 includes an inflow port 8 through which liquid flows in, an outflow port 9 through which the liquid flows out, a circulation path 10 along which the liquid is circulated from the inflow port 8 to the outflow port 9, and a communication port 12 through which the liquid is supplied to the liquid supply chamber 6. Liquid is supplied from the flow path member 7 to the liquid supply chamber 6 of the cover plate 4 via the communication port 12. The liquid supplied from the liquid supply chamber 6 to the respective channels 5 is ejected from nozzles 11 of the actuator substrate 3. No filter is interposed in any of a flow path between the inflow port 8 and the plurality of channels 5, and a flow path between the outflow port 9 and the plurality of channels 5.

With this structure, air bubbles and dust mixed into the liquid that has flowed into the flow path member 7 from the inflow port 8 flow out from the outflow port 9 via the circulation path 10. Further, no filter is interposed between the inflow port 8 or the outflow port 9 and the plurality of channels 5. Therefore, it is possible to prevent the air bubbles from accumulating to the filter to gradually reduce a flow path sectional area, and to prevent an ejection stable zone, which represents a condition range for stable ejection of liquid, from being reduced due to a pressure loss by the filter.

Note that, in the liquid jet head 1 illustrated in FIG. 1, the circulation path 10 of the flow path member 7 and the liquid supply chamber 6 are continuously formed via the communication port 12, but the present invention is not limited to this mode. A separation wall may be provided between the circulation path 10 of the flow path member 7 and the liquid supply chamber 6 of the cover plate 4, and the separation wall may be provided with the communication port 12 for communication of the circulation path 10 and the liquid supply chamber 6. In this case, when the communication port 12 is provided on both of the inflow port 8 side and the outflow port 9 side, the liquid supply chamber 6 can function as a circulation path. Note that, as illustrated in FIG. 1, when the liquid supply chamber 6 and the circulation path 10 are continuously formed, the liquid supply chamber 6 also functions as the circulation path, and hence the effect of the present invention can be further produced.

Further, when a sectional area S1 of the circulation path 10 in a direction orthogonal to a direction of the liquid flow is set larger than a sectional area S2 of the liquid supply chamber 6 in a direction orthogonal to a direction in which the channels 5 are arrayed, a larger amount of liquid flows in the circulation path 10 than in the liquid supply chamber 6 (the liquid supply chamber 6 has an elongated shape long in the direction in which the channels 5 are arrayed). Therefore, the air bubbles and dust that have flowed into the flow path member 7 from the inflow port 8 flow out from the outflow port 9 via the circulation path 10, and hence the nozzles 11 are less likely to be clogged with the air bubbles and dust.

Further, when the circulation path 10 is arranged above the liquid supply chamber 6 in the gravity direction, the air bubbles having a smaller weight than liquid flow out from the outflow port 9 via the circulation path 10 without flowing into the liquid supply chamber 6. Therefore, a disposal amount of liquid at the time of cleaning can be remarkably reduced as compared to a conventional case. Note that, when the liquid jet head 1 is arranged so that the nozzles 11 are arranged below a recording medium (not shown) in the gravity direction, the outflow port 9 is arranged above the circulation path 10 in the gravity direction. In this manner, the air bubbles can be discharged from the liquid supply chamber 6 and the circulation path 10 more effectively. In this case, the inflow port 8 and the circulation path 10 may be communicated and connected to each other in any directions. A specific mode of this structure is described below in a first embodiment of the present invention.

First Embodiment

Figure 2:
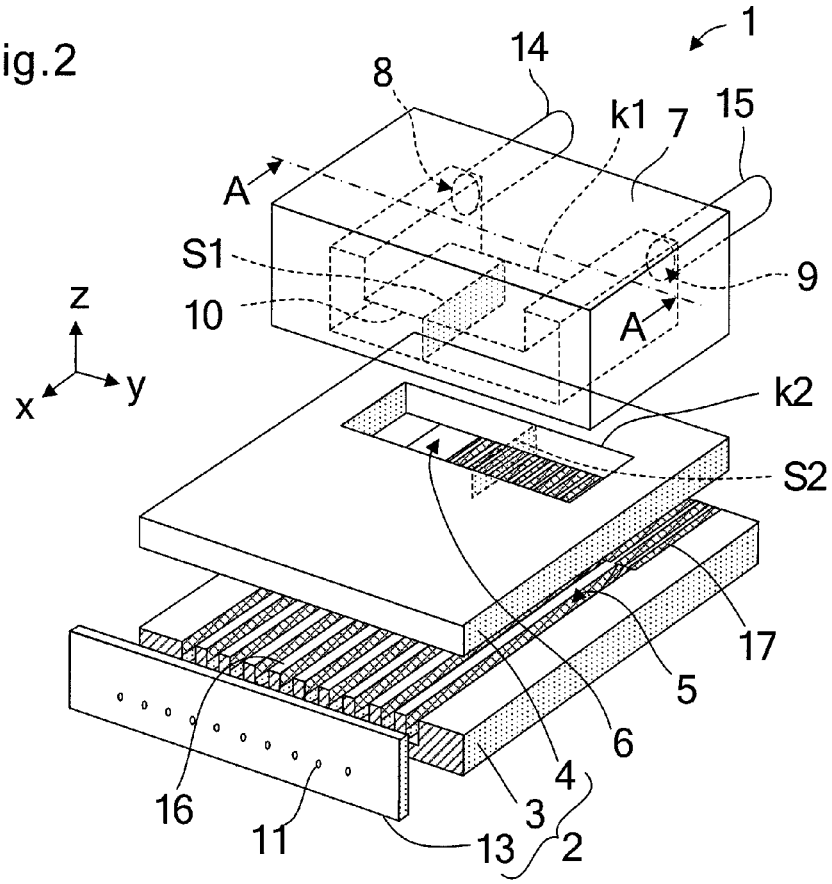
FIG. 2 is a schematic exploded perspective view of a liquid jet head according to a first embodiment of the present invention.

FIG. 2 is a schematic exploded perspective view of a liquid jet head 1 according to a first embodiment of the present invention. As illustrated in FIG. 2, the liquid jet head 1 includes an actuator substrate 3, a cover plate 4 bonded on the actuator substrate 3, and a flow path member 7 bonded on the cover plate 4. A large number of parallel grooves are formed in the surface of the actuator substrate 3. The cover plate 4 and the actuator substrate 3 are bonded to each other to form channels 5. On respective front end surfaces of the actuator substrate 3 and the cover plate 4, a nozzle plate 13 having nozzles 11 communicated to the respective channels 5 is bonded.

A liquid supply chamber 6 is provided in the cover plate 4 on a rear side thereof. The liquid supply chamber 6 is communicated to rear ends of the respective channels 5 so that liquid can be supplied to the respective channels 5. The liquid supply chamber 6 is opened on the flow path member 7 side. On the respective front ends of the actuator substrate 3 and the cover plate 4, the nozzle plate 13 is bonded. The actuator substrate 3, the cover plate 4, and the nozzle plate 13 form a head chip 2. The nozzle plate 13 is provided with the plurality of nozzles 11, and the respective nozzles 11 are communicated to the channels 5. Adjacent channels 5 are separated by a side wall 16, and a drive electrode is formed on a side surface of the side wall 16. The drive electrode is electrically connected to an electrode terminal 17 formed on a rear end surface of the actuator substrate 3.

Inside the flow path member 7, there are formed a circulation path 10 and other flow paths (for example, a flow path between an inflow port 8 and the liquid supply chamber 6). An inflow connection portion 14 is provided to the inflow port 8, and an outflow connection portion 15 is provided to an outflow port 9. The circulation path 10 is opened on the cover plate 4 side. The flow path member 7 and the cover plate 4 are bonded to each other so that an opening of the circulation path 10 and an opening of the liquid supply chamber 6 are overlapped with each other. Therefore, the circulation path 10 and the liquid supply chamber 6 communicate to each other. The liquid supply chamber 6 has a function of supplying liquid to the channels 5, as well as a function as a circulation path that causes the liquid that has flowed into the flow path member 7 from the inflow port 8 to flow out from the outflow port 9.

The liquid jet head 1 operates as follows. Liquid, for example, ink supplied from a liquid storing portion (not shown) to the inflow connection portion 14 is introduced from the inflow port 8 communicated to the inflow connection portion 14 into the flow path member 7. Part of the liquid introduced into the flow path member 7 flows into the liquid supply chamber 6, and is supplied to the respective channels 5. The remaining part of the liquid introduced into the flow path member 7 flows along the circulation path 10 to flow out from the outflow port 9, and returns to the liquid storing portion (not shown) via the outflow connection portion 15. Then, a drive signal generated by a drive portion (not shown) is supplied to the electrode terminal 17 of the actuator substrate 3, and is applied to the drive electrode formed on the side surface of the side wall 16. The side wall 16 is deformed in accordance with the applied drive signal, and thus the internal capacity of the channel 5 changes. In this manner, the liquid filled in the channel 5 is ejected from the nozzle 11.

In the first embodiment of the present invention, the liquid flows into the circulation path 10 from the inflow port 8 in an x direction and flows out from the outflow port 9 in a −x direction, and is ejected from the nozzles 11 in the x direction. Further, the channels 5 are arrayed in a y direction, and hence the liquid supply chamber 6 has an elongated shape long in the y direction. The circulation path 10 of the flow path member 7 has an elongated shape long in the y direction similarly to the liquid supply chamber 6. In the liquid jet head 1, the liquid inflow/outflow direction and the liquid droplet ejection direction are all the x direction. Therefore, the liquid jet head 1 can be formed to be thinned in a z direction, which is orthogonal to the direction of the liquid inflow/outflow and ejection.

In this case, when a sectional area S1 of the circulation path 10 in an xz plane orthogonal to a direction of the liquid flow is formed larger than a sectional area S2 of the liquid supply chamber 6 in the xz plane orthogonal to the longitudinal direction of the liquid supply chamber 6, a flow path sectional area of the circulation path 10 is larger than a flow path sectional area of the liquid supply chamber 6. Therefore, even when air bubbles and dust are mixed into the liquid that has flowed into the flow path member 7 from the inflow port 8, a larger amount of the liquid flows in the circulation path 10 than in the liquid supply chamber 6 and flows out from the outflow port 9. Therefore, the air bubbles and dust are less likely to accumulate in the liquid supply chamber 6, and hence occurrence of a defect of dot missing, which is caused by the clogged nozzle 11, can be reduced.

Further, when the circulation path 10 is arranged above the liquid supply chamber 6 in the gravity direction, the air bubbles flowing into the flow path member 7 from the inflow port 8 flow along the circulation path 10 above the liquid supply chamber 6 to flow out from the outflow port 9, and do not enter the liquid supply chamber 6. Therefore, it is possible to eliminate occurrence of a defect of dot missing, which is caused by the nozzle 11 clogged with the air bubbles. For example, when the liquid jet head 1 is arranged so that the x direction is the lower side and the −x direction is the upper side in the gravity direction, an upper end k1 of the circulation path 10 is formed above an upper end k2 of the liquid supply chamber 6. With this, it is possible to provide a structure in which the air bubbles flowing into the flow path member 7 from the inflow port 8 flow along the circulation path 10, and do not flow into the liquid supply chamber 6.

Note that, in this embodiment, a mode is described in which the nozzles 11 are arranged in a straight line in an arranging direction of the channels 5. Alternatively, the nozzles can be arranged in a staggered pattern, or the present invention can employ a method (three cycle type) in which positions of three nozzles 11 are shifted from one another by a desired distance in the depth direction of the channel 5, and the nozzle group is driven as a set.

Further, in this embodiment, a mode is described in which all of the channels 5 are communicated to the liquid supply chamber 6 (wall sharing type). Alternatively, it is possible to divide the channels 5 into channels to which the liquid is supplied and channels to which liquid is not supplied. In this case, a slit is provided to a position at which the liquid supply chamber 6 is opened to the channels 5, and the slit is formed so as to be opened to the channel 5 to which the liquid is desired to be supplied. In the wall sharing type, it is difficult to eject liquid simultaneously from adjacent channels, and hence modified examples as those described above can be employed as appropriate.

Second Embodiment

Figure 3:
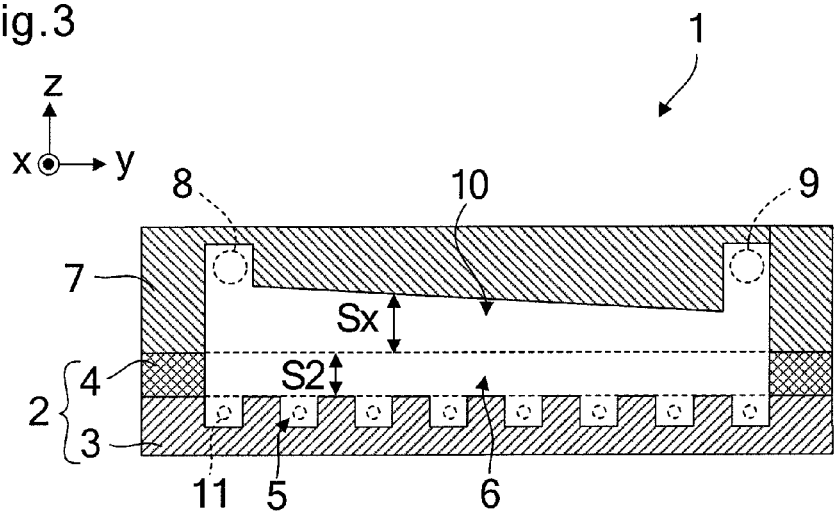
FIG. 3 is a schematic vertical sectional view of a liquid jet head according to a second embodiment of the present invention.

FIG. 3 is a schematic vertical sectional view of a liquid jet head 1 according to a second embodiment of the present invention, which corresponds to a vertical cross-section taken along the line A-A illustrated in FIG. 2. A part different from the first embodiment is the shape of the circulation path 10 formed in the flow path member 7. Other parts are similar to those of the first embodiment.

As illustrated in FIG. 3, the liquid jet head 1 has a structure in which the actuator substrate 3, the cover plate 4, and the flow path member 7 are stacked. The actuator substrate 3 has an upper surface in which the plurality of channels 5 are arranged in parallel to each other, and the respective channels 5 are communicated to the liquid supply chamber 6 formed in the cover plate 4. The head chip 2 is formed of the actuator substrate 3 and the cover plate 4.

The flow path member 7 includes the circulation path 10 opened on the surface thereof on the head chip 2 side, and also includes the inflow port 8 on the −y direction side of the end surface on the −x direction side, and the outflow port 9 on the +y direction side of the end surface on the −x direction side. Each of the inflow port 8 and the outflow port 9 communicates to the circulation path 10. Further, the circulation path 10 has a shape in which a sectional area Sx thereof in the direction orthogonal to the liquid flow (flow to the +y direction) is gradually reduced from the inflow port 8 side to the outflow port 9 side. Note that, the sectional area S2 of the liquid supply chamber 6 in the direction orthogonal to the longitudinal direction thereof is smaller than the sectional area Sx that gradually reduces from the inflow port 8 side to the outflow port 9 side (the smallest sectional area Sx).

With this, the following result can be obtained. When the liquid is ejected from the nozzles 11, the liquid is consumed as the liquid flows in the y direction. The flow path sectional area of the circulation path 10 is narrowed from the liquid inflow side to the liquid outflow side, and hence the flow rate in the circulation path 10 and the inner pressure of each channel 5 can be maintained to a predetermined value or more across a range from the inflow side to the outflow side. As a result, the ejection condition of the liquid can be equalized across a range from the channel on the liquid inflow side to the channel on the liquid outflow side. Further, the air bubbles and dust mixed into the circulation path 10 do not accumulate in the circulation path 10, and can flow toward the outflow port 9.

Third Embodiment

Figure 4:
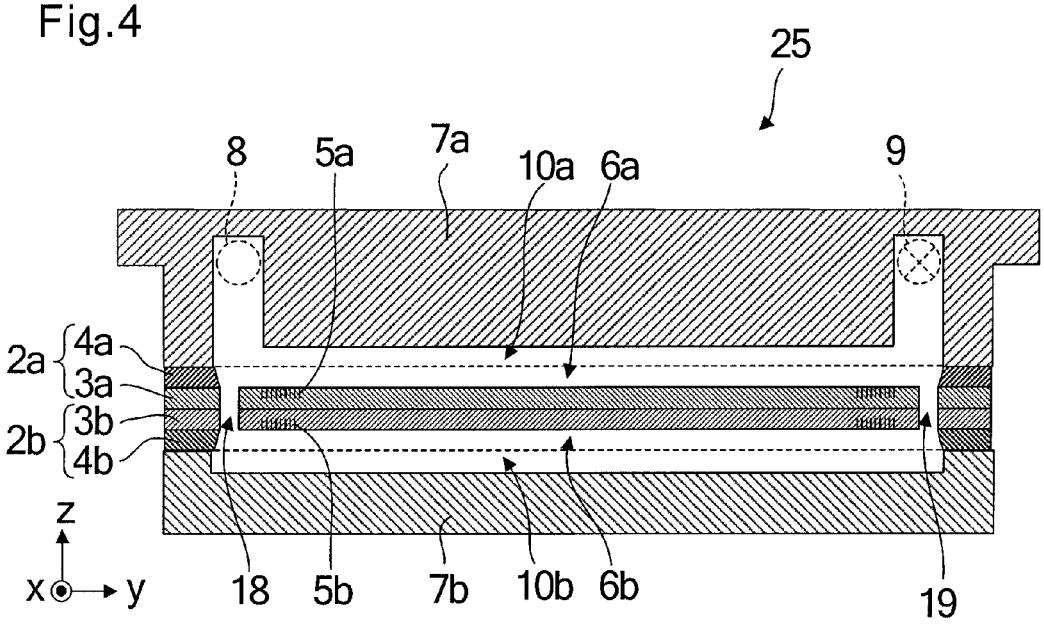
FIG. 4 is a schematic vertical sectional view of a head chip portion of a liquid jet head according to a third embodiment of the present invention.
Figure 5:
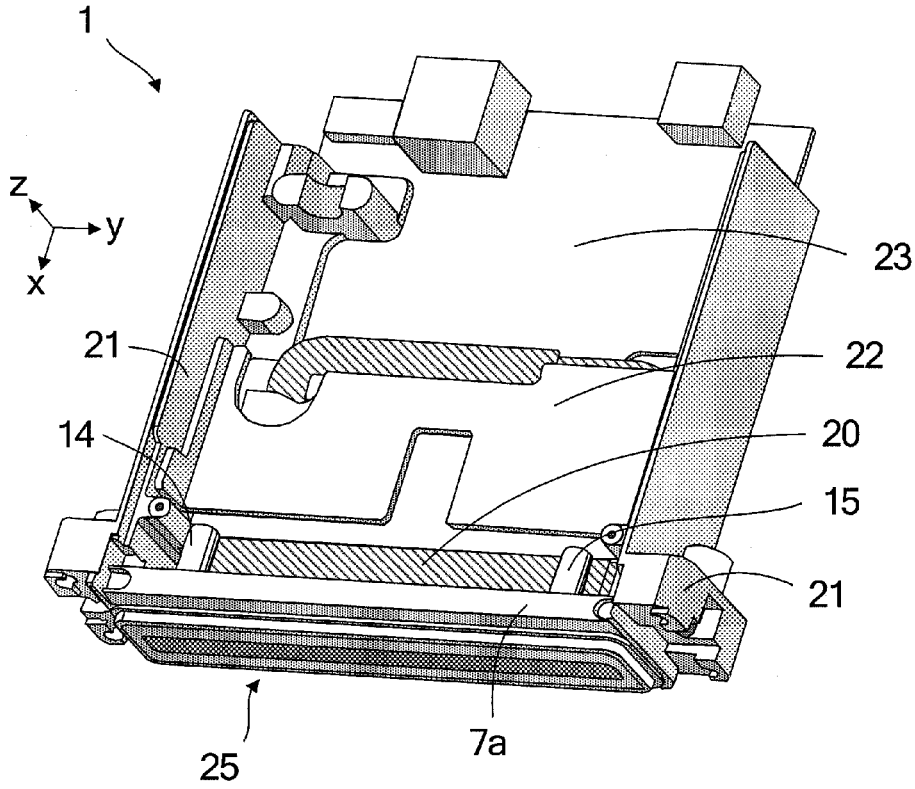
FIG. 5 is a perspective view of the liquid jet head according to the third embodiment of the present invention.

FIGS. 4 and 5 are views illustrating a liquid jet head 1 according to a third embodiment of the present invention. FIG. 4 is a schematic vertical sectional view of a head chip portion 25, and FIG. 5 is a perspective view of the liquid jet head 1 in which the head chip portion 25 is assembled to a base member 21. The same parts and parts having the same functions as those in the above-mentioned embodiments are denoted by the same reference symbols.

As illustrated in FIG. 4, in the head chip portion 25, a first head chip 2*a* and a second head chip 2*b* have a symmetric structure in which an actuator substrate 3*a* of the first head chip 2*a* and an actuator substrate 3*b* of the second head chip 2*b* are opposed and bonded to each other. That is, the first head chip 2*a* includes the actuator substrate 3*a* and a cover plate 4*a* bonded to each other. The actuator substrate 3*a* has a surface having channels 5*a* for liquid ejection formed therein. The cover plate 4*a* includes a liquid supply chamber 6*a* for supplying liquid to the channels 5*a*. The second head chip 2*b* includes the actuator substrate 3*b* and a cover plate 4*b* bonded to each other. The actuator substrate 3*b* has a surface having channels 5*b* for liquid ejection formed therein. The cover plate 4*b* includes a liquid supply chamber 6*b* for supplying liquid to the channels 5*b*. The actuator substrates 3*a* and 3*b* are bonded to each other under a state in which surfaces thereof on sides opposite to the channels 5*a* and 5*b* are opposed to each other.

Further, from one end portion of the liquid supply chamber 6*a* formed in the cover plate 4*a* to one end portion of the liquid supply chamber 6*b* formed in the cover plate 4*b*, there is formed an inflow through hole 18 passing through the two actuator substrates 3*a* and 3*b*. Further, from another end portion of the liquid supply chamber 6*b* to another end portion of the liquid supply chamber 6*a*, there is formed an outflow through hole 19 passing through the two actuator substrates 3*a* and 3*b*.

A flow path member 7*a* includes the inflow port 8, the outflow port 9, and a circulation path 10*a* opened on the cover plate 4*a* side, and is bonded to a surface of the cover plate 4*a* so that an opening portion of the circulation path 10*a* and an opening portion of the liquid supply chamber 6*a* are overlapped with each other. The flow path member 7*b* includes a circulation path 10*b*, and is bonded to a surface of the cover plate 4*b* so that an opening portion of the circulation path 10*b* and an opening portion of the liquid supply chamber 6*b* are overlapped with each other.

Liquid that has flowed into the flow path member 7*a* from the inflow port 8 thereof is filled in the liquid supply chamber 6*a* of the cover plate 4*a*. The liquid is supplied to the respective channels 5*a* of the actuator substrate 3*a* and flows via the circulation path 10*a* to flow out from the outflow port 9. Further, the liquid that has flowed into the flow path member 7*a* from the inflow port 8 is supplied to the liquid supply chamber 6*b* via the inflow through hole 18, and is supplied to the respective channels 5*b* of the actuator substrate 3*b*. Further, the liquid flows via the circulation path 10*b* and the outflow through hole 19 to flow out from the outflow port 9.

As described above, the two rows of channels 5*a* and 5*b* are formed, and hence recording can be performed at high density. Further, the circulation paths 10*a* and 10*b* are provided on respective outer sides of the two liquid supply chambers 6*a* and 6*b*, and hence the air bubbles and dust mixed into the liquid that has flowed into the flow path member 7*a* from the inflow port 8 flow via the circulation paths 10*a* and 10*b* to flow out from the outflow port 9. Further, no filter is interposed between the inflow port 8 or the outflow port 9 and the plurality of channels 5*a* and 5*b*. Therefore, it is possible to prevent the air bubbles from accumulating to the filter to gradually reduce the flow path sectional area, and to prevent the ejection stable zone from being reduced due to the pressure loss by the filter.

Note that, when a sectional area of the circulation path 10*a* in the direction orthogonal to the direction of the liquid flow is formed larger than a sectional area of the liquid supply chamber 6*a* in a direction orthogonal to a direction in which the channels 5*a* communicated to the liquid supply chamber 6*a* are arrayed, a larger amount of liquid flowing into the flow path member 7*a* from the inflow port 8 flows in the circulation path 10*a* than in the liquid supply chamber 6*a*. Therefore, the air bubbles and dust mixed into the liquid flow out from the outflow port 9 together with the liquid, and hence the air bubbles and dust are less likely to accumulate in the liquid supply chamber 6*a*. Thus, occurrence of a defect of dot missing, which is caused by the clogged nozzle, can be reduced. In addition, when a sectional area of the circulation path 10*b* in a direction orthogonal to the direction of the liquid flow is formed larger than a sectional area of the liquid supply chamber 6*b* in a direction orthogonal to a direction in which the channels 5*b* communicated to the liquid supply chamber 6*b* are arrayed, similarly to the above-mentioned case, the air bubbles and dust flow out from the outflow port 9, and hence occurrence of a defect of dot missing, which is caused by the clogged nozzle, can be reduced.

Further, when the circulation paths 10*a* and 10*b* are arranged above the liquid supply chambers 6*a* and 6*b* in the gravity direction, respectively, the air bubbles flowing into the flow path member 7*a* from the inflow port 8 flow along the circulation paths 10*a* and 10*b* to flow out from the outflow port 9, and do not flow into the liquid supply chambers 6*a* and 6*b*. For example, it is assumed that the +x direction is the lower side and the −x direction is the upper side in the gravity direction. In this case, the circulation paths 10*a* and 10*b* may be formed so as to extend in the −x direction with respect to the liquid supply chambers 6*a* and 6*b*.

Note that, the inflow through hole 18 and the outflow through hole 19 may be formed at any positions as long as the positions are between the outermost channel 5 of the plurality of channels 5, and each end portion of the actuator substrates 3*a* and 3*b* in the y direction. Further, as illustrated in FIG. 4, the liquid supply chambers 6*a* and 6*b* may be directly communicated to each other, or a partition wall may be provided to the cover plates 4*a* and 4*b* to separate the liquid supply chambers 6*a* and 6*b* from each other. When the liquid supply chambers 6*a* and 6*b* are separated, it is necessary to provide hole portions (not shown) to the cover plates 4*a* and 4*b* so as to communicate to the inflow through hole 18 and the outflow through hole 19, respectively. Those hole portions are communicated to the circulation path 10*a* and the circulation path 10*b*, respectively.

As illustrated in FIG. 5, the head chip portion 25 is assembled to the base member 21. The head chip portion 25 includes the inflow connection portion 14 for liquid inflow and the outflow connection portion 15 for liquid outflow and circulation. The base member 21 includes a heat sink plate 22 and a circuit board 23. A flexible board 20 electrically connects between the head chip portion 25 and the heat sink plate 22, and between the heat sink plate 22 and the circuit board 23. A driver IC (not shown) is mounted on the rear side of the heat sink plate 22, and generates a drive signal for driving the actuator substrates 3*a* and 3*b* based on a signal from the circuit board 23.

As described above, the liquid flows into the circulation paths 10*a* and 10*b* from the inflow port 8 in the x direction and flows out from the outflow port 9 in the −x direction, and is ejected from the nozzles 11 in the x direction. Therefore, the thickness of the liquid jet head 1 in the z direction orthogonal to the x direction can be reduced. As a result, it is possible to arrange a plurality of liquid jet heads 1 on a carriage unit in the z direction in a compact manner.

Fourth Embodiment

Figure 6:
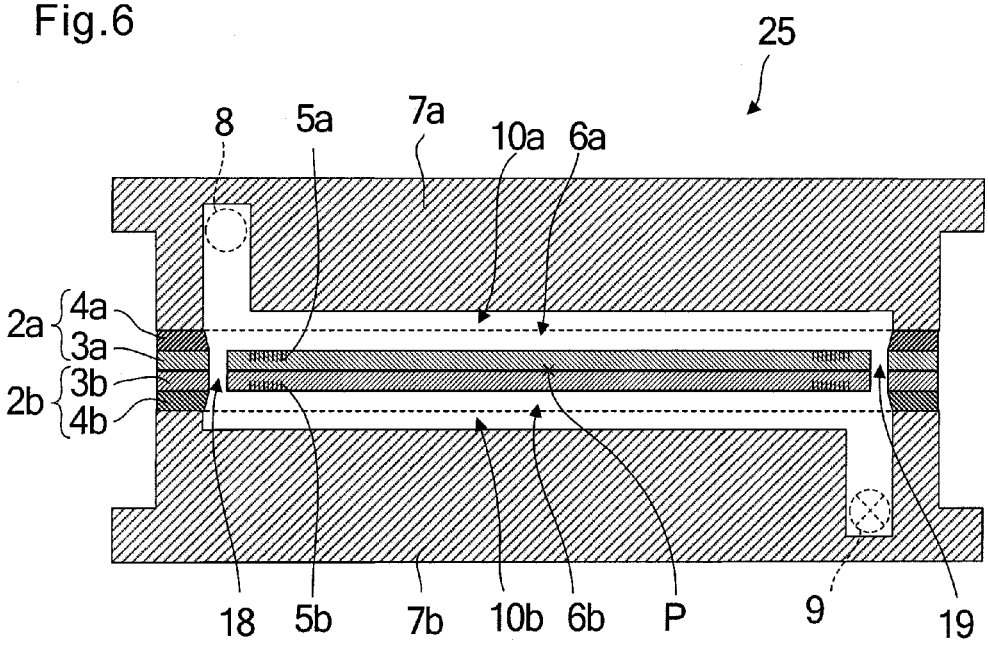
FIG. 6 is a schematic vertical sectional view of a head chip portion of a liquid jet head according to a fourth embodiment of the present invention.

FIG. 6 is a schematic vertical sectional view of a head chip portion 25 of a liquid jet head 1 according to a fourth embodiment of the present invention. A part different from the head chip portion 25 of the third embodiment is the structure of the flow path members 7*a* and 7*b*, and other parts are similar to those of the third embodiment. Hereinafter, the different part is mainly described, and description of the same parts is omitted.

As illustrated in FIG. 6, the flow path member 7*a* includes the inflow port 8 and the circulation path 10*a* opened on the cover plate 4*a* side, and is bonded to the surface of the cover plate 4*a* so that the opening portion of the circulation path 10*a* and the opening portion of the liquid supply chamber 6*a* are overlapped with each other. The flow path member 7*b* includes the outflow port 9 and the circulation path 10*b* opened on the cover plate 4*b* side, and is bonded to the surface of the cover plate 4*b* so that the opening portion of the circulation path 10*b* and the opening portion of the liquid supply chamber 6*b* are overlapped with each other. At one end portion and another end portion of the head chips 2*a* and 2*b*, there are formed the inflow through hole 18 and the outflow through hole 19, respectively, which pass through the cover plate 4*a*, the actuator substrate 3*a*, the actuator substrate 3*b*, and the cover plate 4*b*.

Therefore, liquid that has flowed into the flow path member 7*a* from the inflow port 8 is filled in the liquid supply chamber 6*a* of the cover plate 4*a*. The liquid is supplied to the respective channels 5*a* of the actuator substrate 3*a* and flows along the circulation path 10*a*. Further, the liquid that has flowed into the flow path member 7*a* from the inflow port 8 is filled in the liquid supply chamber 6*b* via the inflow through hole 18. The liquid is supplied to the respective channels 5*b* of the actuator substrate 3*b* and flows along the circulation path 10*b*. The liquid flowing along the circulation path 10*b* and the liquid flowing out the circulation path 10*a* via the outflow through hole 19 are merged to flow out from the outflow port 9.

The flow path formed in the head chip portion 25 has a line-symmetric structure with respect to a straight line passing through a central point P in a perpendicular direction of the drawing sheet. Therefore, the flow rate in the circulation path 10*a* and the flow rate in the circulation path 10*b* are equal to each other. Further, the flow path members 7*a* and 7*b* and the head chips 2*a* and 2*b* each have the same shape, and hence the respective members can be shared. Therefore, designing and manufacturing may be facilitated.

Fifth Embodiment

Figure 7:
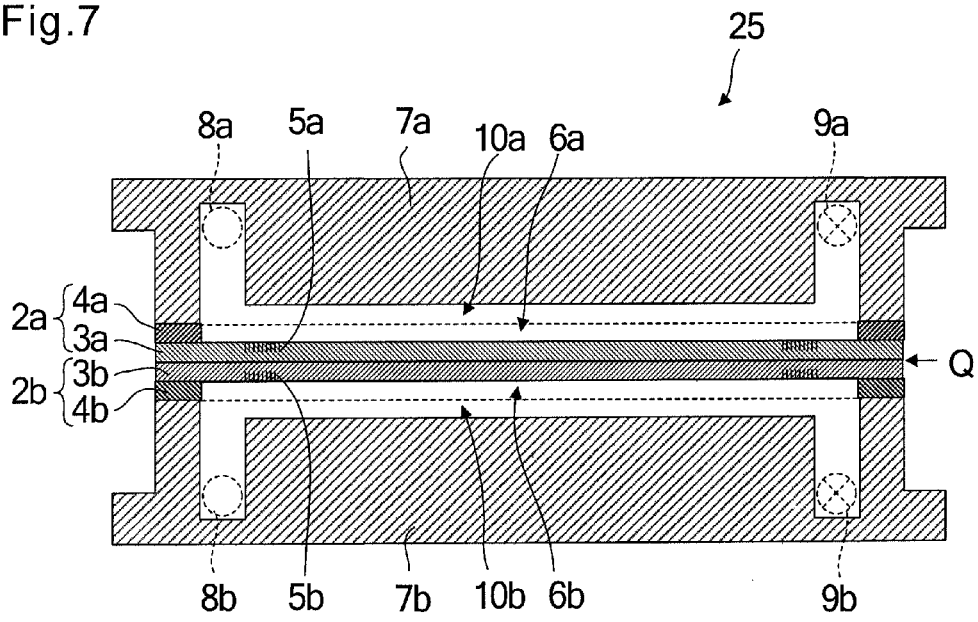
FIG. 7 is a schematic vertical sectional view of a head chip portion of a liquid jet head according to a fifth embodiment of the present invention.

FIG. 7 is a schematic vertical sectional view of a head chip portion 25 of a liquid jet head 1 according to a fifth embodiment of the present invention. This head chip portion 25 is different from the head chip portion 25 of the third embodiment in the structure of the flow path members 7*a* and 7*b* and in that the inflow through hole 18 and the outflow through hole 19 are not formed, and other parts are similar to those of the third embodiment. Hereinafter, the different parts are mainly described, and description of the same parts is omitted.

As illustrated in FIG. 7, the flow path member 7*a* includes an inflow port 8*a*, the circulation path 10*a* opened on the cover plate 4*a* side, and an outflow port 9*a*. Similarly, the flow path member 7*b* includes an inflow port 8*b*, the circulation path 10*b* opened on the cover plate 4*b* side, and an outflow port 9*b*. Further, no through hole is formed in the cover plates 4*a* and 4*b* and the actuator substrates 3*a* and 3*b*. That is, two stacking members, which are each obtained by stacking the flow path member on the head chip in which the actuator substrate and the cover plate are stacked, are inverted to form a structure which is plane-symmetric with respect to a plane Q at which the actuator substrates 3*a* and 3*b* are bonded to each other. Note that, the inflow ports 8*a* and 8*b* and the outflow ports 9*a* and 9*b* are each positioned on the same side in the y direction. With the structure formed as described above, flow path tubes which are positioned immediately before liquid inflow through the inflow ports 8*a* and 8*b* can be shared with ease. The liquid is circulated independently through each stacking member.

With the structure described above, the flow rate of liquid flowing along each of the two circulation paths 10*a* and 10*b*, and the amount and pressure of liquid to be supplied to the two liquid supply chambers 6*a* and 6*b* can be independently controlled, and hence fluctuations of ejection characteristics of the two channels 5*a* and 5*b* can be reduced. Further, maintenance such as cleaning can be independently performed.

Sixth Embodiment

Figure 8:
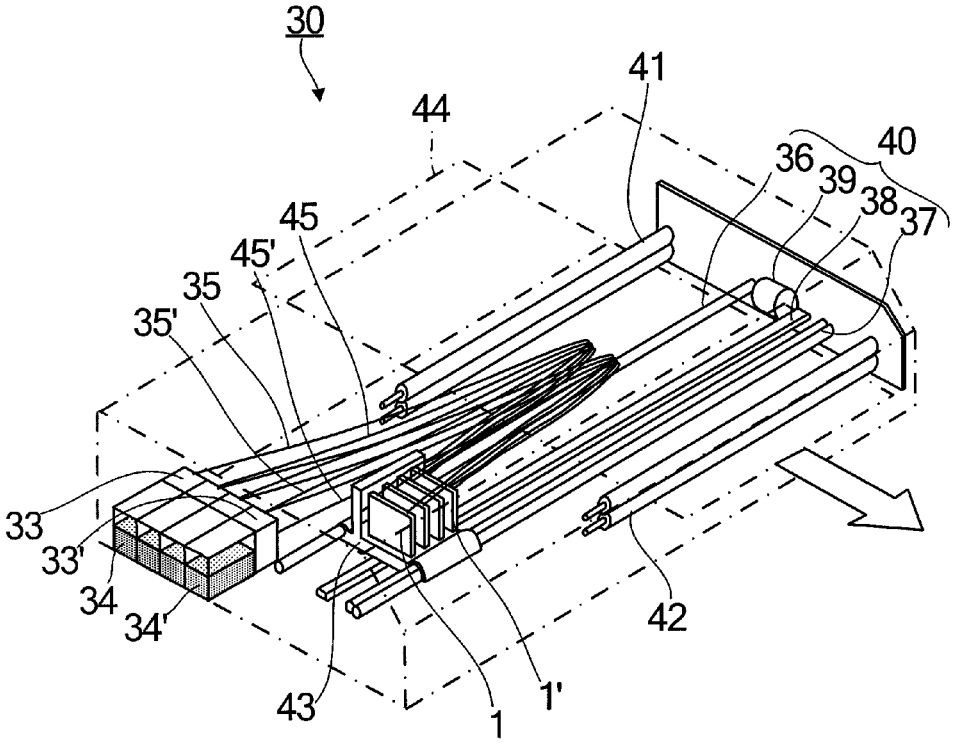
FIG. 8 is a schematic perspective view of a liquid jet apparatus according to a sixth embodiment of the present invention.
Figure 9:
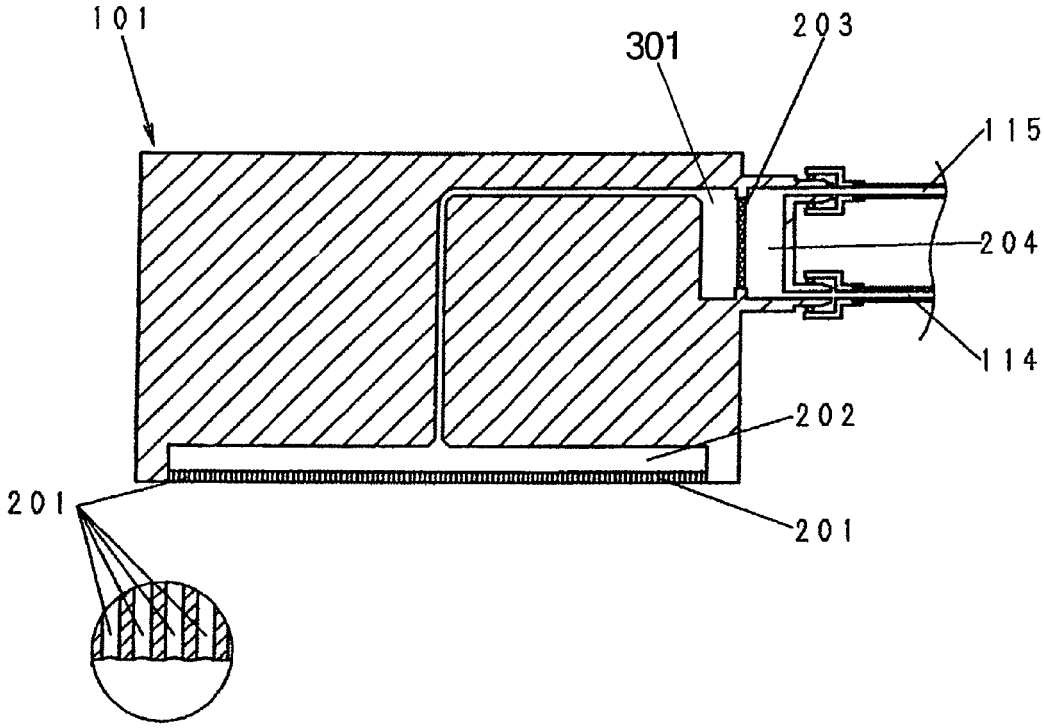
Fig.9 PRIOR ART
FIG. 9 is a schematic view illustrating an ink flow path of a conventionally known printing head.

FIG. 8 is a schematic perspective view of a liquid jet apparatus 30 according to a sixth embodiment of the present invention. The liquid jet apparatus 30 includes a moving mechanism 40 for reciprocating liquid jet heads 1 and 1', supply tubes 35 and 35' for supplying liquid to the liquid jet heads 1 and 1', respectively, collection tubes 45 and 45' for collecting liquid from the liquid jet heads 1 and 1', respectively, and liquid pumps 33 and 33' and liquid tanks 34 and 34' for supplying liquid under pressure to the supply tubes 35 and 35', respectively. The liquid jet heads 1 and 1' each include a plurality of ejection grooves, and a liquid droplet is ejected from a nozzle communicating with each of the ejection grooves. As the respective liquid jet heads 1 and 1', the liquid jet heads already described in any one of the first to fifth embodiments are used.

The liquid jet apparatus 30 includes a pair of transport means 41 and 42 for transporting a recording medium 44 such as paper in a main scanning direction, the liquid jet heads 1 and 1' for ejecting liquid onto the recording medium 44, a carriage unit 43 for mounting the liquid jet heads 1 and 1' thereon, the liquid pumps 33 and 33' for pressing liquid stored in the liquid tanks 34 and 34' to supply the liquid to the supply tubes 35 and 35', respectively, and the moving mechanism 40 for causing the liquid jet heads 1 and 1' to perform scanning in a sub-scanning direction orthogonal to the main scanning direction. A control portion (not shown) controls and drives the liquid jet heads 1 and 1', the moving mechanism 40, and the transport means 41 and 42.

The pair of transport means 41 and 42 each extend in the sub-scanning direction, and include a grid roller and a pinch roller which rotate with their roller surfaces being in contact with each other. The grid roller and the pinch roller are rotated about their shafts by means of a motor (not shown) to transport the recording medium 44 sandwiched between the rollers in the main scanning direction. The moving mechanism 40 includes a pair of guide rails 36 and 37 extending in the sub-scanning direction, the carriage unit 43 capable of sliding along the pair of guide rails 36 and 37, an endless belt 38 to which the carriage unit 43 is connected for moving the carriage unit 43 in the sub-scanning direction, and a motor 39 for rotating the endless belt 38 through pulleys (not shown).

The carriage unit 43 has the plurality of liquid jet heads 1 and 1' mounted thereon for ejecting liquid droplets of four types, for example, yellow, magenta, cyan, and black. The liquid tanks 34 and 34' store liquid of corresponding colors, and supply the liquid via the liquid pumps 33 and 33' and the supply tubes 35 and 35' to the liquid jet heads 1 and 1', respectively. The liquid is collected in the liquid tanks 34 and 34' via the collection tubes 45 and 45', respectively. The liquid jet heads 1 and 1' each eject a liquid droplet of each color according to a drive signal. By controlling the timing to eject the liquid from the liquid jet heads 1 and 1', the rotation of the motor 39 for driving the carriage unit 43, and the transport speed of the recording medium 44, an arbitrary pattern may be recorded onto the recording medium 44.

In the liquid jet apparatus 30 of the present invention, the flow path member of the head chip is provided with a circulation path along which the liquid is circulated, and hence air bubbles and dust mixed into the liquid flow out via the circulation path. Further, no filter is interposed in any of the flow path between the inflow port and the channels and the flow path between the outflow port and the channels. Therefore, it is possible to provide a liquid jet apparatus capable of preventing the air bubbles from accumulating to the filter to reduce the flow path sectional area, and preventing the ejection stable zone from being reduced due to the pressure loss by the filter.

What is claimed is:

1. A liquid jet head, comprising:

a head chip comprising an actuator substrate having a plurality of channels for liquid ejection arrayed on a surface of the actuator substrate; and a cover plate having a liquid supply chamber for supplying liquid to the plurality of channels, the cover plate being stacked on the actuator substrate, wherein the liquid supply chamber communicates with the plurality of channels and has an elongated shape long in an arraying direction of the plurality of channels; and a flow path member disposed on the cover plate for supplying the liquid to the liquid supply chamber, the flow path member comprising an inflow port through which the liquid flows in; an outflow port through which the liquid flows out; and a circulation path along which the liquid is circulated from the inflow port to the outflow port, wherein no filter is interposed in any of a flow path between the inflow port and the channel and a flow path between the outflow port and the plurality of channels, and wherein the circulation path has a sectional area in a direction orthogonal to a circulating direction of a liquid flow, which is larger than a sectional area of the liquid supply chamber in a direction orthogonal to the elongated direction thereof.

2. A liquid jet head according to claim 1, wherein the liquid supply chamber is opened on a surface of the cover plate on the flow path member side, wherein the circulation path is opened on a surface of the flow path member on the cover plate side, and wherein the circulation path and the liquid supply chamber are arranged so that an opening of the circulation path and an opening of the liquid supply chamber overlap each other.

3. A liquid jet head according to claim 1, wherein the sectional area of the circulation path in the direction orthogonal to the direction of the liquid flow gradually reduces from an upstream side to a downstream side.

4. A liquid jet head according to claim 1, wherein the head chip comprises a first head chip and a second head chip stacked one on the other.

5. A liquid jet head according to claim 4, wherein the first head chip and the second head chip have a symmetric structure in which an actuator substrate of the first head chip and an actuator substrate of the second head chip are opposed and bonded to each other, wherein the flow path member comprises:

a first flow path member disposed on the first head chip; and a second flow path member disposed on the second head chip, wherein the head chip comprises an inflow through hole and an outflow through hole which pass through the head chip from the first flow path member side to the second flow path member side, and wherein the liquid flows into the second flow path member from the first flow path member via the inflow through hole, and flows into the first flow path member from the second flow path member via the outflow through hole.

6. A liquid jet head according to claim 4, wherein the first head chip and the second head chip have a symmetric structure in which an actuator substrate of the first head chip and an actuator substrate of the second head chip are opposed and bonded to each other, wherein the flow path member comprises:

a first flow path member disposed on the first head chip; and a second flow path member disposed on the second head chip, and wherein the first flow path member and the second flow path member have a symmetric structure across the first head chip and the second head chip.

7. A liquid jet head according to claim 1, wherein the circulation path is arranged above the liquid supply chamber in a gravity direction.

8. A liquid jet apparatus, comprising:

the liquid jet head according to claim 1;

a moving mechanism for reciprocating the liquid jet head;

a liquid supply tube for supplying liquid to the liquid jet head; and a liquid tank for supplying the liquid to the liquid supply tube.

9. A liquid jet head according to claim 1, wherein the head chip comprises a first head chip and a second head chip stacked one on the other.

10. A liquid jet head according to claim 9, wherein the first head chip and the second head chip have a symmetric structure in which an actuator substrate of the first head chip and an actuator substrate of the second head chip are opposed and bonded to each other, wherein the flow path member comprises:

a first flow path member disposed on the first head chip; and a second flow path member disposed on the second head chip, wherein the head chip comprises an inflow through hole and an outflow through hole which pass through the head chip from the first flow path member side to the second flow path member side, and wherein the liquid flows into the second flow path member from the first flow path member via the inflow through hole, and flows into the first flow path member from the second flow path member via the outflow through hole.

11. A liquid jet head according to claim 9, wherein the first head chip and the second head chip have a symmetric structure in which an actuator substrate of the first head chip and an actuator substrate of the second head chip are opposed and bonded to each other, wherein the flow path member comprises:

a first flow path member disposed on the first head chip; and a second flow path member disposed on the second head chip, and wherein the first flow path member and the second flow path member have a symmetric structure across the first head chip and the second head chip.

* * * * *